US006085728A

United States Patent [19]

Grosser et al.

[11] Patent Number: 6,085,728

[45] Date of Patent: Jul. 11, 2000

[54] METHOD FOR OPERATING A SELF-IGNITING, AIR-COMPRESSING INTERNAL COMBUSTION ENGINE

[75] Inventors: Martin Grosser, Korntal-Muenchingen; Udo Schulz, Vaihingen/enz, both of Germany

[73] Assignee: Robert Bosch GmbH, Stuttgart, Germany

[21] Appl. No.: 09/174,422

[22] Filed: Oct. 19, 1998

[30] Foreign Application Priority Data

Nov. 3, 1997 [DD] German Dem. Rep. ..... 197 48 420

[51] Int. Cl.[7] ..... F02M 37/04

[52] U.S. Cl. ..... 123/447; 123/198 D

[58] Field of Search ..... 123/198 D, 447, 123/497, 198 DB, 456, 458

[56] References Cited

U.S. PATENT DOCUMENTS

| | | | |
|---|---|---|---|
| 5,433,182 | 7/1995 | Augustin | 123/456 |
| 5,456,233 | 10/1995 | Felhofer | 123/456 |
| 5,507,266 | 4/1996 | Wright | 123/497 |
| 5,572,974 | 11/1996 | Wakeman | 123/497 |
| 5,727,516 | 3/1998 | Augustin | 123/198 DB |
| 5,727,525 | 3/1998 | Tsuzuki | 123/447 |
| 5,850,818 | 12/1998 | Yoshiume | 123/198 D |
| 5,878,718 | 3/1999 | Rembold | 127/456 |
| 5,937,826 | 8/1999 | Olson | 123/198 D |

FOREIGN PATENT DOCUMENTS

| | | |
|---|---|---|
| 19520300 | 5/1996 | Germany . |
| 1 95 34 050 A1 | 3/1997 | Germany . |
| 19604552 | 8/1997 | Germany . |
| 19640826 | 10/1997 | Germany . |

*Primary Examiner*—Carl S. Miller

*Attorney, Agent, or Firm*—Ronald E. Greigg; Edwin E. Greigg

[57] ABSTRACT

A method for operating a self-igniting, air-compressing internal combustion engine, in which the engine is supplied with fuel by an injection system that has a high-pressure fuel reservoir, which is supplied with fuel by a high-pressure fuel pump and outputs fuel to electrically controlled injection valves. A control unit is provided, which detects the operating mode of the engine and upon occurrence of an overrunning mode allows a pressure increase in the high-pressure fuel reservoir. On resumption of normal operation, the drive of the high-pressure fuel pump is then interrupted, and the engine is supplied from the fuel previously stored at elevated pressure, until a lower limit value of the high pressure fuel is attained.

5 Claims, 1 Drawing Sheet

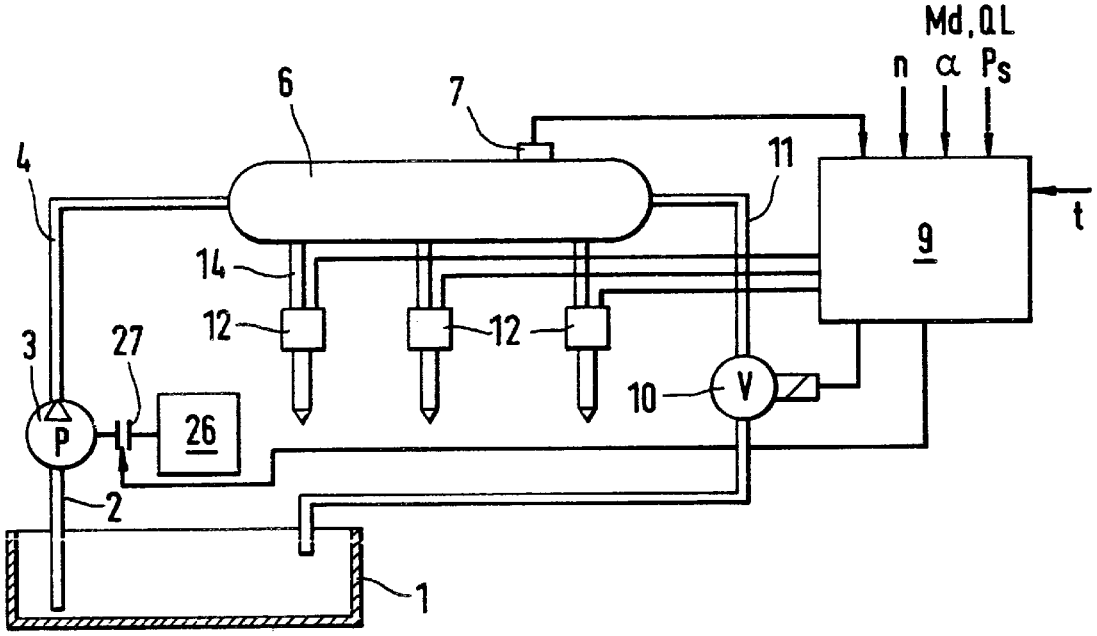
Md, QL
n
α
Ps
6
7
4
11
9
t
14
12
12
3
27
26
P
10
V
2
1

METHOD FOR OPERATING A SELF-IGNITING, AIR-COMPRESSING INTERNAL COMBUSTION ENGINE

BACKGROUND OF THE INVENTION

The invention is based on a method for operating a self-igniting, air-compressing internal combustion engine. One such method is employed in the subject of German Patent Disclosure DE-A1 195 34 050. In it, the fact that high-pressure reservoirs can come to leak and the escaping fuel can cause severe damage at the leak is taken into account. To limit the damage if a leak occurs, suitable safeguarding provisions are proposed in this reference.

Fuel injection systems of this known type advantageously serve to inject fuel at high pressure; the fuel to be injected can be metered very exactly, and the injection can be made very flexible, because of the electrically controlled fuel injection valves used.

OBJECT AND SUMMARY OF THE INVENTION

The characteristics recited herein attains the substantial advantage that in engine operating ranges in which only little power is demanded of the engine, for instance as in overrunning of a motor vehicle driven by this engine, the reservoir pressure in the high-pressure fuel reservoir can be increased without a substantial loss in driving power, and on resumption of operation where greater power is demanded of the engine, this pressure can be reduced down to a lower limit value without requiring a resupply of high-pressure fuel into the high-pressure fuel reservoir by the high-pressure fuel pump. Thus, on load resumption by the engine, the driving power of the high-pressure fuel pump is dispensed with, so that the engine for driving a motor vehicle has increased power available for acceleration, compared with other normal operation. This power increase that is briefly available until the fuel pressure in the high-pressure fuel reservoir is reduced improves performance of the engine and motor vehicle unit. Advantageously, at the transition between engine overrunning and the engine driving range, the control unit disconnects the high-pressure fuel pump from the drive of the high-pressure fuel pump and an electrically controllable clutch, for instance, is employed. This kind of electrically controllable clutch is indeed disclosed in the reference mentioned above, but the switching of this clutch there serves merely to discontinue high-pressure fuel pumping entirely in the event of danger.

The invention will be better understood and further objects and advantages thereof will become more apparent from the ensuing detailed description of a preferred embodiment taken in conjunction with the drawing.

BRIEF DESCRIPTION OF THE DRAWING

The sole FIGURE of the drawing shows a fuel injection system in simplified form.

DESCRIPTION OF THE PREFERRED EMBODIMENT

The method will be explained in terms of a fuel injection system as shown in the drawing. A fuel supply container 1 is provided, from which a high-pressure fuel pump 3 aspirates fuel via an intake line 2 and pumps it via a pressure line 4 at high pressure into a high-pressure fuel reservoir 6. The fuel pressure in this high-pressure fuel reservoir is monitored by a pressure sensor 7, and the signal value output by this sensor is compared in a control unit 9 with a set-point value. If there is a deviation, a pressure control device 10 is triggered, for instance such that via an adjustable valve disposed in a relief line 11 of the high-pressure fuel reservoir 6, excess fuel is pumped back into the tank. On the other hand, an intervention can also be made into the pumping power of the high-pressure pump 3; in an embodiment as a piston pump, the effective pumping stroke of this piston pump is adjusted, or the fuel delivery to this high-pressure pump is controlled by the control unit 9.

As intended, the high-pressure fuel reservoir supplies a plurality of fuel injection valves 12 with fuel via pressure lines 14. The instant of injection of fuel and the duration of injection in these fuel injection valves is controlled electrically by the control unit 9. To that end, control magnet or piezoelectric valves, for instance, are provided, which are controlled to suit requirements, for instance on the basis of rpm and load. The control unit detects engine operating parameters and the demands made of this engine with regard to the torque to be output. These parameters are for instance the rpm, an angle encoder that detects the desired torque or load demand of an actuated control device, the intake tube pressure or charge pressure, or the outcome of measurement by an air flow rate meter that detects the quantity of air delivered to the combustion chambers. In addition, still other parameters can be detected, such as coolant temperature and air temperature, and in addition input signals can be entered in accordance with the phase position of the crankshafts or camshaft, in order to control the injection onset and injection quantity exactly.

In this fuel injection system, the high-pressure fuel reservoir is kept in normal operation at pressure levels of greater than 500 bar. For safety reasons, however, the maximum allowable pressure in the high-pressure fuel reservoir is substantially higher, for instance 1600 bar. If the engine, which for instance drives a motor vehicle, is operated in the overrunning mode, then no fuel or only a very slight fuel quantity is then drawn from the high-pressure fuel reservoir for injection, as long as the overrunning mode is defined such that on the basis of torques acting from outside on the engine in the direction of an increase in rpm, the rpm referred to the injection quantity is exceeded. The special case exists if for instance a torque demand, input via a gas pedal, is reduced to the specified value for idling, and on the basis of the forces acting from outside the engine continues to remain at rpm levels above the idling rpm. In these ranges, the delivery of fuel to the engine can be disrupted entirely. In principle, however, within this operating range as well, the pressure in the high-pressure fuel reservoir remains at a high level without a need to resupply fuel. In these ranges, in which no substantial drive power is demanded of the engine, however, the pressure in the high-pressure fuel reservoir can be increased up to an upper overrunning set-point value, which is above the normal operation set-point value for the pressure and can for instance be 1200 bar, compared with 700 bar otherwise. The pressure increase, together with the compressibility of the fuel in the high-pressure fuel reservoir, increases the available fuel volume, which on the one hand represents an additional fuel reserve for a resumption of normal operation outside the overrunning phase. This reserve can be consumed by injection in the ensuing load takeup phase, without a need to resupply high-pressure fuel. It is therefore advantageous, in the period of time within which fuel is available, prestored, for supply to the engine, to turn off the operation of the high-pressure fuel pump and not to turn this pump on again unless a lower limit value of the pressure in the high-pressure fuel reservoir is reached. At the instant of load takeup, this makes increased power for the engine available compared with normal operation, which increases the acceleration capability of the engine. Once the fuel stored at increased reservoir pressure has been used, the first phase of load resumption, which uses the most energy, has by then often already elapsed.

As a drive for the high pressure pump, the crankshaft of the engine can be used, for instance, or a motor 26, supplied from the on-board electrical system of the engine, can be used, which is coupled to the high-pressure fuel pump via an electrically switchable clutch 27.

The foregoing relates to a preferred exemplary embodiment of the invention, it being understood that other variants and embodiments thereof are possible within the spirit and scope of the invention, the latter being defined by the appended claims.

We claim:

1. A method for operating a self-igniting, air-compressing internal combustion engine for driving a motor vehicle, which comprises supplying the engine with injection fuel by a fuel injection system, supplying a high-pressure fuel reservoir which is supplied with high-pressure fuel by a high-pressure fuel pump, measuring the pressure of the fuel being supplied, and maintaining the supplied fuel in the fuel reservoir at a normal value by a control unit, controlling electrically controlled fuel injection valves which draw fuel from the high-pressure fuel reservoir for injecting the fuel into combustion chambers of the engine, by aid of the control unit, detecting the operating state of the engine, and upon attainment of an engine overrunning phase, regulating the fuel pressure in the high-pressure fuel reservoir by the control unit which sets the fuel pressure to an upper overrunning set-point value, which is higher than the upper normal operating set-point value set by the control unit for the driving mode of the engine, and on resumption of the driving mode of the engine and if a lower limit value of the fuel pressure in the high-pressure fuel reservoir is exceeded, disconnecting the high-pressure fuel pump from its drive, and reconnecting the drive of the high pressure fuel pump when the lower limit value of the fuel pressure in the high-pressure fuel reservoir is reached.

2. The method according to claim 1, in which the overrunning set-point value is 1200 bar, and a normal operation set-point value is 500 to 900 bar.

3. A fuel injection system for supplying an internal combustion engine with fuel, which comprises a high pressure fuel pump, an outlet of said high pressure pump is connected to a high-pressure fuel reservoir, said high-pressure fuel pump aspirates fuel from a fuel supply container and supplies the fuel to the high-pressure fuel reservoir at high pressure in order to attain a high injection pressure that is available to fuel injection valves, said fuel injection valves communicate with the high-pressure fuel reservoir and are electrically controlled by a control unit; the high-pressure fuel reservoir is provided with a pressure sensor which is connected to the control unit and measures the instantaneous fuel pressure; one of the high-pressure fuel pump or the high-pressure fuel reservoir is assigned a control device, a desired pressure in the high-pressure fuel reservoir is controlled by the control unit which can be set by means of a limitation of the outflow of high pressure fuel from or the inflow to the high-pressure fuel reservoir; said high-pressure fuel pump has a fuel pump drive which is controllable by the control unit and said fuel pump drive is operatively disconnectable by said control unit from the high-pressure fuel pump, an overrunning detection device is provided, which is connected to the control unit, and a set-point value transducer for the fuel pressure to be maintained in the high-pressure fuel reservoir in the overrunning mode is provided.

4. The apparatus according to claim 1, in which an electrically controllable clutch is provided to disconnect the drive from the high-pressure fuel pump, said clutch is opened to interrupt the drive and is closed to restore the drive.

5. The apparatus according to claim 4, in which the clutch additionally serves as a safety shutoff device, if malfunctions that occur in the injection system or the engine are detected by the control unit.

* * * * *